US006029850A

United States Patent [19]

Pate et al.

[11] Patent Number: 6,029,850

[45] Date of Patent: Feb. 29, 2000

[54] SOFT SIDED GOLF BALL DISPENSER

[75] Inventors: Craig R. Pate, 2334 S. 133 St., New Berlin, Wis. 53151; Miguel Fiol, Edina, Minn.

[73] Assignee: Craig R. Pate, New Berlin, Wis.

[21] Appl. No.: 08/947,122

[22] Filed: Oct. 8, 1997

[51] Int. Cl.[7] ..... B65D 83/00

[52] U.S. Cl. ..... 221/64; 206/315.9; 224/919

[58] Field of Search ..... 221/64, 303, 307, 221/185; 206/315.9; 224/919

[56] References Cited

U.S. PATENT DOCUMENTS

| | | | |
|---|---|---|---|
| 3,112,046 | 11/1963 | Szekely | 221/64 |
| 5,772,090 | 6/1998 | Rodriguez | 221/307 |
| 5,839,631 | 11/1998 | Hebert et al. | 206/315.9 |

*Primary Examiner*—Kenneth W. Noland
*Attorney, Agent, or Firm*—Quarles & Brady

[57] ABSTRACT

A container for golf balls receives the golf balls into a bore of a resilient tube where they are held by combined frictional and deformational forces. The balls are released by a peristaltic squeezing of the outer soft sides of the container.

5 Claims, 1 Drawing Sheet

FIG. 1
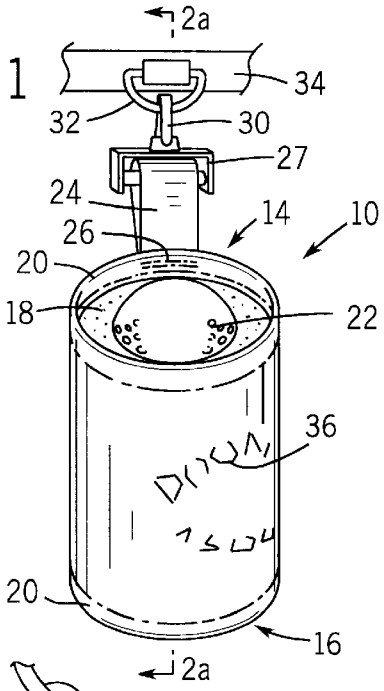
FIG. 2a
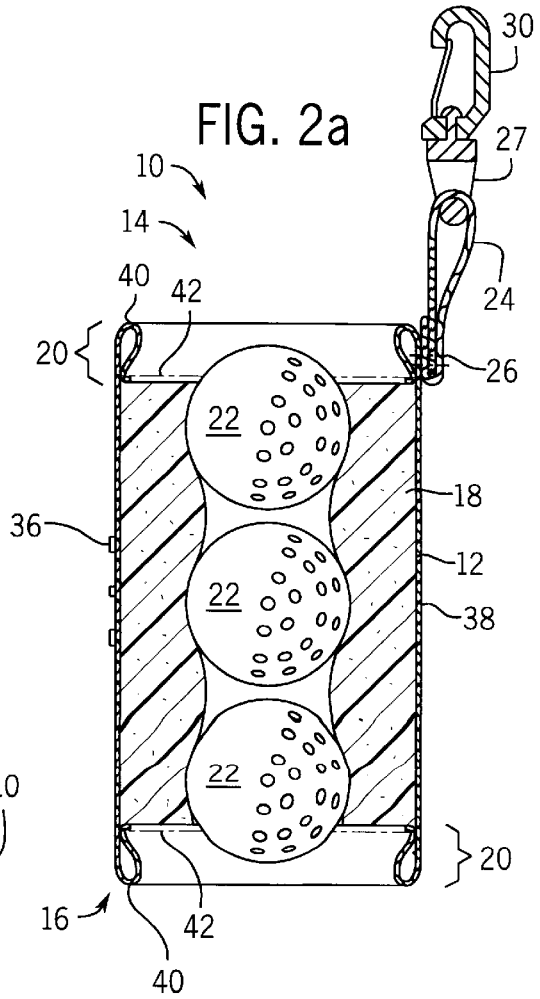
FIG. 3
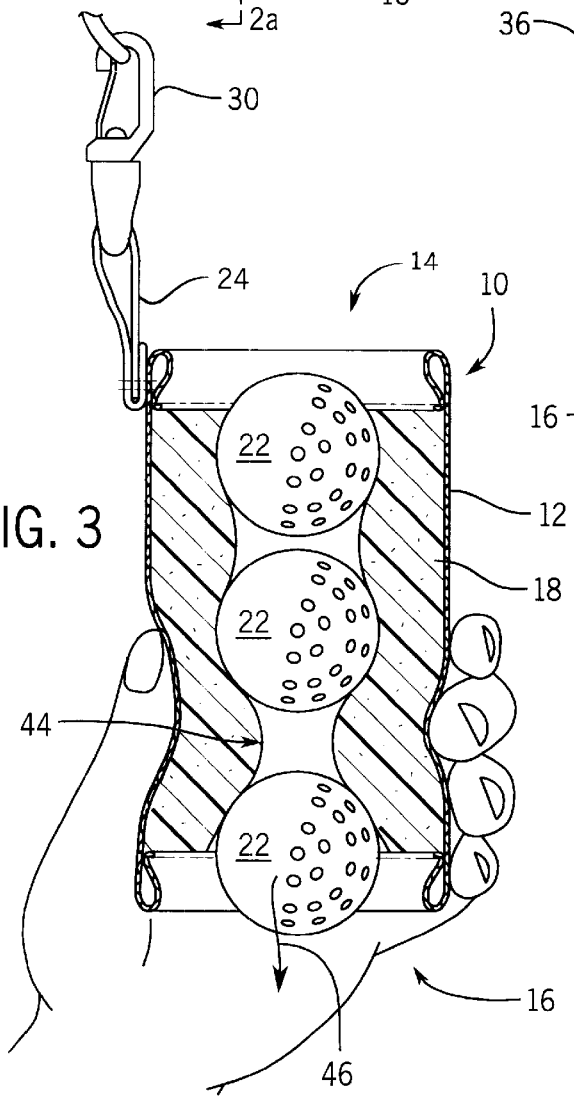
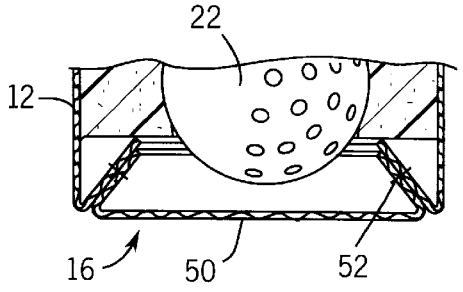
FIG. 2b

SOFT SIDED GOLF BALL DISPENSER

FIELD OF THE INVENTION

The present invention relates to golf equipment and in particular to a container for holding and dispensing golf balls.

BACKGROUND OF THE INVENTION

In the sport of golf, it is not uncommon for golf balls to be lost or replaced during a round. Extra balls may be carried in a golf bag which includes zippered pouches or pockets holding the balls as well as many other accessories. Retrieving a ball from these pouches and pockets of the golf bag is frequently time consuming and awkward.

SUMMARY OF THE INVENTION

The present invention provides a convenient container for golf balls that may be clipped to the outside of a golf bag for easy access. The container includes a resilient tube that holds the balls firmly when they are inserted into its bore, but which allows the balls to be easily dispensed once inserted by squeezing the outer, soft sides of the container with one's fingers.

Specifically, the invention provides a container having a resilient tube with an inner uncompressed diameter less than the diameter of a regulation golf ball. The inner surface of the tube deforms outwardly to admit at least one golf ball therein, and the outer surface of the tube deforms inwardly to expel a golf ball therefrom.

Thus it is one object of the invention to provide a simple container for golf balls that holds the balls securely yet allows them to be quickly released for use.

The resilient tube may be an elastic polymer foam and the container may include an outer fabric sleeve coaxially surrounding the resilient tube to resist outward deformation of the outer surface of the tube.

Thus it is another object of the invention to permit the use of readily available polymer foam materials for the resilient tube. The fabric sleeve resists relaxation of the resilient tube in outward expansion and provides a means of attaching the container to a golf cart or the like and a surface for supporting labeling of the container.

The outer fabric sleeve may include a hem of folded fabric around at least one end of the sleeve, the hem providing an inwardly extending lip of fabric engaging a corresponding end of the resilient tube.

Thus it is another object of the invention to provide a cost effective means for assembling the fabric sleeve and the resilient tube that does not interfere with operation of the container. The hem engages the outer surface of the resilient tube to resist relative motion between the two.

The container may include a strap having one end affixed to an end of the resilient tube, typically via the fabric sleeve, to suspend the resilient tube in substantially vertical orientation when another end of the strap is attached to a support. The strap may hold a clip attached to the other end of the strap for attaching the other end of the strap to a ring.

It is thus another object of the invention to provide a container that may be attached to the outside of a golf cart or the like to securely hold golf balls yet to provide ready access to them when needed.

The foregoing and other objects and advantages of the invention will appear from the following description. In this description, references are made to the accompanying drawings which form a part hereof, and in which there are shown, by way of illustration, preferred embodiments of the invention. Such embodiments do not necessarily represent the full scope of the invention, however, and reference must be made therefore to the claims for interpreting the scope of the invention.

BRIEF DESCRIPTION OF THE DRAWINGS

FIG. 1 is a perspective view of the present invention as attached to a ring on a golf bag or the like for easy access;

FIG. 2*a* is a cross section through the holder/dispenser of FIG. 1 along lines 2—2 of FIG. 1 showing the deformation of the bore of an internal foam tube securing three golf balls therein, and showing a first embodiment of the invention where both ends of the foam tube are open for dispensing golf balls;

FIG. 2*b* is a fragmentary view similar to that of 2*a* showing a second embodiment where a lower end of the foam tube is enclosed with a fabric panel; and FIG. 3 is a simplified view similar to that of FIG. 2*a* showing a squeezing of the outer surfaces of the holder/dispenser 10 of FIG. 1 such as to dispense a golf ball.

DETAILED DESCRIPTION OF THE PREFERRED EMBODIMENT

Referring to FIGS. 1 and 2*a*, a holder/dispenser 10 of the present invention has a generally cylindrical outer fabric sleeve 12 open at an upper base 14 and lower base 16. The fabric sleeve 12 may be formed by rolling a panel of fabric into a cylinder to be attached to itself along a seam line 38 running vertically along the length of the fabric sleeve 12 parallel to its axis at a rear face. The upper and lower edges of the cylinder so formed may be rolled inward and downward to provide hems 40 which may be attached back to the cylinder by stitching 42. The front outer surface of the fabric sleeve 12 may hold embroidery 36 or be silk screen for promotional purposes. The fabric may be either cloth or a flexible cloth-like material.

The open ends of the fabric sleeve 12 expose a coaxial cylindrical foam tube 18 held within the fabric sleeve 12. In the preferred embodiment, the fabric sleeve 12 is constructed of an inelastic material that restrains outward the expansion of the cylindrical foam tube. The foam tube 18 may be, for example, an elastic polymer foam such as expanded polyurethane foam or other similar material. In a preferred embodiment, the foam tube 18 makes use of a commercially available pipe insulating foam having a ½" wall thickness and a 1⅜" inside diameter.

The inner foam tube 18 is slightly shorter than the fabric sleeve 12 so that the hem 40 provides a skirt region 20 at the top and bottom of the holder/dispenser 10 where the fabric sleeve 12 extends upward and downward, respectively, beyond the ends of the foam tube 18.

A fabric loop 24 extends upward from the upper skirt 20 on a rear side of the fabric sleeve 12 above the seam line 38 attached by stitching 26 to the upper skirt region 20. Held within the loop 24 is an eye portion 27 of a swivel hasp 30 such as may attach to a ring 32 on a golf bag 34 or the like.

Referring to FIG. 2*b* in a second embodiment, the lower base 16 may be covered by a fabric panel 50 of similar material to the fabric sleeve 12 and attached to the lower edge of the fabric sleeve 12 prior to its hemming by stitches 52 according to techniques well understood in the art.

One or more regulation sized golf balls 22 may be inserted within the central bore of the cylindrical foam tube 18 to be held therein by the force of friction between the inner walls of the bore of the foam tube and the outer surface of the golf balls 22. This frictional force is adjusted by the proper selection of the diameter of the central bore of the foam tube 18. Specifically, the central bore of the foam tube 18 has a diameter somewhat less than that of the contained golf balls 22 so that when a golf ball 22 is inserted within the bore of the foam tube 18, the walls of the foam tube 18 are compressed to exert a greater force against the golf balls 22. The outer circumferential dimension of the foam tube is constrained by the relatively inelastic fabric sleeve 12.

In the embodiment of FIG. 2*a*, golf balls may be inserted either from the upper base 14 or the lower base 16. In the embodiment of FIG. 2*b*, golf balls may be inserted only from the upper base 14. The number of golf balls 22 that may be inserted within the foam cylinder may be varied as a function primarily of its length but typically the foam tube 18 will be sufficiently long to accommodate two or three golf balls. Each golf ball 22 when inserted pushes the previous golf ball further to the interior of the foam tube 18.

Referring now to FIG. 3, dispensing of the golf balls 22 is easily accomplished by squeezing the outer surface of the holder/dispenser 10 along an equatorial line separating any two golf balls 22 such as may be detected by feel through the soft fabric sleeve 12 and foam tube 18. The squeezing creates a region of constriction 44 which peristaltically urges a golf ball 22 toward the upper base 14 (in the second embodiment) or the lower base 16 (in the first embodiment) to propel the golf ball 22 onto the ground as indicated by arrow 46.

The holder/dispenser 10 represents a fairly large target and the equatorial region between balls may be quickly determined so the process of dispensing a ball is relatively quick. On the other hand, the balls are firmly held against being dislodged by normal agitation of the holder/dispenser 10 itself.

The above description has been that of a preferred embodiment of the present invention. It will occur to those that practice the art that many modifications may be made without departing from the spirit and scope of the invention. In order to appraise the public of the various embodiments that may fall within the scope of the invention, the following claims are made:

We claim:

1. A golf ball container comprising:

a resilient elastic polymer foam tube having an inner uncompressed diameter less than the diameter of a regulation golf ball, an inner surface of the tube deformable outwardly to admit at least one golf ball therein, an outer surface of the tube deformable inwardly to expel a golf ball therefrom;

a separate outer fabric sleeve coaxially surrounding the resilient elastic polymer foam tube to resist outward deformation of the outer surface of the tube; and wherein the outer fabric sleeve includes a hem of folded fabric around at least one end of the sleeve, the hem providing an inwardly extending lip of fabric engaging a corresponding end of the resilient tube.

2. The golf ball container of claim 1 including a strap having one end affixed to an end of the resilient tube to suspend the resilient tube in substantially vertical orientation when an other end of the strap is attached to a support.

3. The golf ball container of claim 2 including a clip attached to the other end of the strap for attaching the other end of the strap to a ring.

4. The golf ball container of claim 1 wherein the resilient tube is open at two ends to receive and discharge golf balls from either of the two ends.

5. The golf ball container of claim 1 wherein the resilient tube is closed at one end by a panel of the fabric sleeve.

* * * * *